US005314795A

United States Patent [19]

Helland et al.

[11] Patent Number: 5,314,795

[45] Date of Patent: May 24, 1994

[54] THERMAL-DYE-BLEACH CONSTRUCTION COMPRISING A POLYMETHINE DYE AND A THERMAL CARBANION-GENERATING AGENT

[75] Inventors: Randall H. Helland, Maplewood; Sylvia A. Farnum, Lakeland, both of Minn.; Mark P. Kirk, Bishop's Stortford, England; Jonathan P. Kitchin, White Bear Lake, Minn.; Roger A. Mader, Stillwater, Minn.; Mark B. Mizen; Richard A. Newmark, both of St. Paul, Minn.; William D. Ramsden, Afton, Minn.; Kumars Sakizadeh, Woodbury, Minn.; Terence D. Spawn, Maplewood, Minn.; Dian E. Stevenson, Saffron Walden, England; George V. Tiers, St. Paul, Minn.

[73] Assignee: Minnesota Mining and Manufacturing Company, St. Paul, Minn.

[21] Appl. No.: 993,650

[22] Filed: Dec. 21, 1992

[51] Int. Cl.[5] ..... G03C 1/06; G03C 1/815; G03C 1/825

[52] U.S. Cl. ..... 430/517; 430/522; 430/339; 430/944; 430/964; 252/583; 252/587

[58] Field of Search ..... 430/517, 522, 339, 944, 430/964; 252/583, 587

[56] References Cited

U.S. PATENT DOCUMENTS

| | | | |
|---|---|---|---|
| 3,220,846 | 11/1965 | Tinker et al. | 96/91 |
| 3,609,360 | 9/1969 | Wiese | 250/65 T |
| 3,619,194 | 11/1969 | Mitchell | 96/84 |
| 3,627,527 | 12/1971 | Gilman et al. | 96/1.6 |
| 3,684,552 | 8/1972 | Wiese et al. | 117/36.8 |
| 3,769,019 | 10/1973 | Wiese, Jr. et al. | 96/84 R |
| 3,852,093 | 12/1974 | O'Leary | 117/36.8 |
| 3,892,569 | 7/1975 | Speers | 96/67 |
| 4,033,948 | 7/1977 | Brown | 260/240 |
| 4,060,420 | 11/1977 | Merkel et al. | 96/114.1 |
| 4,088,497 | 5/1978 | Brown et al. | 96/114.1 |
| 4,196,002 | 4/1980 | Levinson et al. | 430/617 |
| 4,197,131 | 4/1980 | Lea et al. | 430/617 |
| 4,201,590 | 5/1980 | Levinson et al. | 430/617 |
| 4,283,487 | 8/1981 | Lea et al. | 430/522 |
| 4,312,941 | 1/1982 | Scharf et al. | 430/510 |
| 4,499,180 | 2/1985 | Hirai et al. | 430/559 |
| 4,511,650 | 4/1985 | Hirai et al. | 430/559 |
| 4,560,763 | 12/1985 | Sato et al. | 546/341 |
| 4,581,323 | 4/1986 | Fisher et al. | 430/513 |
| 4,581,325 | 4/1986 | Kitchin et al. | 430/522 |
| 4,705,737 | 11/1987 | Hirai et al. | 430/203 |
| 4,731,321 | 3/1988 | Sato et al. | 430/559 |
| 4,740,455 | 4/1988 | Kubodera et al. | 430/617 |
| 4,842,977 | 6/1989 | Kakimi | 430/138 |
| 4,939,064 | 7/1990 | Nakamura | 430/138 |
| 4,981,965 | 1/1991 | Yabuki et al. | 544/196 |
| 5,135,842 | 8/1992 | Kitchin et al. | 430/510 |

FOREIGN PATENT DOCUMENTS

| | | |
|---|---|---|
| 0377961 | 11/1989 | European Pat. Off. . |
| 0403157 | 6/1990 | European Pat. Off. . |

*Primary Examiner*—Charles L. Bowers, Jr.
*Assistant Examiner*—Geraldine Letscher
*Attorney, Agent, or Firm*—Gary L. Griswold; Walter N. Kirn; Gregory A. Evearitt

[57] ABSTRACT

A thermal-dye-bleach construction comprising a polymethine dye having a nucleus of general formula I:

in association with a thermal-carbanion-generating agent having the general formula:

wherein the substituents are as defined in the specification and claims.

19 Claims, 2 Drawing Sheets

THERMAL-DYE-BLEACH CONSTRUCTION COMPRISING A POLYMETHINE DYE AND A THERMAL CARBANION-GENERATING AGENT

BACKGROUND TO THE INVENTION

1. Field of the Invention

This invention relates to thermal-dye-bleach constructions, and in particular, it relates to thermal-dye-bleach constructions for photographic, photothermographic, and thermographic imaging. The constructions comprise a class of polymethine dyes and a non-labile-hydrogen-containing cationic salt of a phenylsulfonylacetic acid as a bleaching agent for the dyes, the salt being capable of generating a carbanion upon thermolysis (i.e., a thermal-carbanion-generating agent). The thermal-dye-bleach constructions are suitable for use as acutance and antihalation systems, bleachable filter dye materials, and in thermal recording processes.

2. Background of the Art

The increasing availability and use of semiconductor light sources, and particularly laser diodes which emit in the red and near-infrared region of the electromagnetic spectrum, have led to a need for high quality photographic materials which are sensitive in this region, especially from 633 nm to 850 nm Light-sensitive recording materials suffer from a phenomenon known as halation which causes degradation in the quality of the recorded image. Such degradation occurs when a fraction of the imaging light which strikes the photosensitive layer is not absorbed, but instead passes through to the film base on which the photosensitive layer is coated. A portion of the light reaching the base may be reflected back to strike the photosensitive layer from the underside. Light thus reflected may, in some cases, contribute significantly to the total exposure of the photosensitive layer. Any particulate matter in the photosensitive element may also cause light passing through the element to be scattered. Scattered light which is reflected from the film base will, on its second passage through the photosensitive layer, cause exposure over an area adjacent to the point of intended exposure. This effect leads to image degradation. Silver halide-based photographic materials (including photothermographic materials) are prone to this form of image degradation since the photosensitive layers contain light-scattering particles (see, T. N. James, "The Theory of the Photographic Process", 4th Edition, Chapter 20, MacMillan 1977).

In order to improve the image sharpness of photographic materials, it is customary to incorporate a dye in one or more layers of the material, the purpose of which is to absorb light that has been scattered within the coating and would otherwise lead to reduced image sharpness. To be effective, the absorption of this layer must be at the same wavelength as the sensitivity of the photosensitive layer.

In the case of imaging materials coated on a transparent base, a light-absorbing layer is frequently coated in a separate backing layer or underlayer on the reverse side of the substrate from the photosensitive layer. Such a coating, known as an "antihalation layer", effectively reduces reflection of any light which has passed through the photosensitive layer. A similar effect may be achieved by interposing a light-absorbing layer between the photosensitive layer and the substrate. This construction, known in the art as an "antihalation underlayer", is applicable to photosensitive coatings on non-transparent as well as on transparent substrates.

A light-absorbing substance may also be incorporated into the photosensitive layer itself in order to absorb scattered light. Substances used for this purpose are known as "acutance dyes." It is also possible to improve image quality by coating a light-absorbing layer above the photosensitive layer of a photographic element. Coatings of this kind, described in U.S. Pat. Nos. 4,312,941, 4,581,323 and 4,581,325, reduce multiple reflections of scattered light between the internal surfaces of a photographic element.

It is usually essential that coatings of antihalation or acutance dyes which absorb in the visible region of the spectrum should completely decolorize under the processing conditions of the photographic material concerned. This may be achieved by a variety of methods, such as by washing out or by chemical reaction in wet processing techniques, or by thermal bleaching during heat processing techniques. In the case of photothermographic materials which are processed by simply heating for a short period, usually between 100° C. and 200° C., antihalation or acutance dyes used must decolorize thermally.

Various thermal-dye-bleach systems are known in the art including single compounds which spontaneously decompose and decolorize at elevated temperatures and combinations of dye and thermal-dye-bleaching agent which together form a thermal-dye-bleach system.

European Publication No. EP 0,377,961 A discloses the use of certain polymethine dyes for infrared antihalation in both wet-processed and dry-processed photographic materials. The dyes bleach completely during wet-processing, but remain unbleached after dry-processing. This is acceptable for some purposes because infrared dyes have a relatively small component of their absorption in the visible region. This absorption can be masked, for example, by using a blue-tinted polyester base. For most applications, however, it is preferable that the dyes bleach completely during dry-processing, leaving no residual stain.

U.S. Pat. No. 5,135,842 describes thermal-dye-bleach constructions employing guanidinium salts of phenylsulfonylacetic acids and polymethine dyes such as I and (disclosed later herein). Upon heating, these salts liberate guanidine which nucleophilically adds to the polymethine chain, thereby disrupting conjugation and decolorizing the dye. However, thermal-dye-bleach constructions employing guanidinium salts have relatively short shelf life, are subject to premature bleaching, and, upon heating, display slow bleaching over a broad temperature range.

Many substances are known which absorb visible and/or ultraviolet light, and many are suitable for image improvement purposes in conventional photographic elements sensitized to wavelengths below 650 nm. Triarylmethane and oxonol dyes, in particular, are used extensively in this connection. U.S. Pat. Nos. 3,609,360, 3,619,194, 3,627,527, 3,684,552, 3,852,093, 4,033,948, 4,088,497, 4,196,002, 4,197,131, 4,201,590 and 4,283,487 disclose various thermal-dye-bleach systems which absorb principally in the visible region of the electromagnetic spectrum and as such, are not readily adaptable for use as far-red or near-infrared absorbing constructions. No indication or examples are given of far-red or near-infrared absorbing thermal-dye-bleach systems.

A variety of thermal-base-releasing agents are known and have been used in both diazo- and silver-containing photothermographic materials. However, the purpose of incorporating thermal base-releasing agents into photothermographic constructions has been to increase the basicity (i.e., alkalinity) of the medium during thermal processing, thereby promoting the development reaction.

For example, U.S. Pat. No. 4,939,064 describes the use of amidine salts of carboxylic acids as base precursors contained within light-sensitive silver halide layers. An amidine base is released by thermolytic decarboxylation of a carboxylic acid to generate a carbanion which removes one or two protons from an amidine salt. The thus release amidine base renders the medium basic so that a polymerization reaction can proceed.

U.S. Pat. No. 4,842,977 describes the use of guanidinium salts as base precursors contained in particles arranged on the outside of microcapsules containing silver halide and a polymerizable compound. The guanidinium base thus released renders the medium basic so that a polymerization reaction can occur.

U.S. Pat. No. 4,560,763 describes the use of amine salts of $\alpha,\beta$-acetylenic carboxylic acids as base precursors in photosensitive materials. The amine salts have a labile proton. Again, thermolysis of these materials releases the free base which accelerates reaction of a developing agent for silver halide.

U.S. Pat. No. 4,981,965 describes the use of guanidinium salts of phenylsulfonylacetic acids as base precursors. The diacidic to tetra-acidic base precursors are composed of two to four guanidinium units. In these systems, thermolysis of the salt results in decarboxylation to form a phenylsulfonylmethyl anion. This anion abstracts a proton from the guanidinium salt to release the free base. This base can then provide the alkalinity required for a number of image-forming processes.

U.S. Pat. No. 4,060,420 describes the use of ammonium salts of phenylsulfonylacetic acids as activator-stabilizers in photothermographic systems. In these systems the ammonium species is always a protonated basic nitrogen, and thus has at least one labile hydrogen atom. U.S. Pat. No. 4,731,321 discloses ammonium salts of phenylsulfonylacetic acid as base precursors in heat-developable light-sensitive materials.

Japanese Patent Application No. 1-150575 discloses thermally-releasable bisamines in the form of their-bis-(arylsulfonylacetic acid) salts. Other amine-releasing compounds include 2-carboxycarboxamide derivatives disclosed in U.S. Pat. No. 4,088,496; hydroxylamine carbamates disclosed in U.S. Pat. No. 4,511,650; and aldoxime carbamates disclosed in U.S. Pat. No. 4,499,180.

The above items use an ammonium or guanidinium salt having at least one labile hydrogen atom as the cation for the carboxylic acid anion. In all of the above cases, the ammonium salt serves to release a base; that is, the base is derived from the cationic portion of the molecule. In none of the above items was a quaternary ammonium salt, free of labile hydrogen atoms (such as a tetra-alkyl ammonium salt), used as the cation for a carboxylic acid. In none of the above cases was a non-labile-proton-containing cationic salt of a carboxylic acid used as the basis of a thermographic imaging system or as the basis of an anti-halation coating of a photothermographic imaging system. Finally, in none of the above items was the anionic portion of the salt used as the bleaching species.

U.S. Pat. Nos. 3,220,846 discloses the use of tetra-alkylammonium salts of readily decarboxylated carboxylic acids to generate a basic medium which promotes coupling of two reactants to form a dye. These materials are taught to be useful in thermography, photography, photothermography, and thermophotography.

U.S. Pat. Nos. 3,684,552, and 3,769,019 disclose the use of tetra-alkylammonium salts of cyanoacetic acid as bleaching agents for light- and heat-sensitive materials. These are unacceptable due to liberation of volatile, toxic nitriles.

U.S. Pat. No. 4,705,737 describes the use of ammonium phenylsulfonylacetate salts as base generators in heat developable photothermographic layers. Several quaternary-ammonium phenylsulfonylacetate salts are included. The salts are contained in the photosensitive silver halide layer and, after imaging and upon heating, serve to render the photosensitive layer sufficiently alkaline for dye formation, dye coupling, or dye release. The photothermographic layers described are hydrophilic and gelatin-based.

SUMMARY OF THE INVENTION

It has now been found that certain-thermally generated carbanions will bleach polymethine dyes upon heating. The present invention provides a thermal-dye-bleach construction comprising a polymethine dye having a nucleus of general formula I:

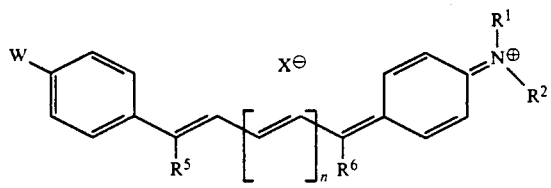

wherein:

n is 0, 1, 2, or 3;

W is selected from: hydrogen, alkyl groups of up to 10 carbon atoms, alkoxy and alkylthio groups of up to 10 carbon atoms, aryloxy and arylthio groups of up to 10 carbon atoms, $NR^1R^2$, and $NR^3R^4$;

$R^1$ to $R^4$ are each independently selected from: alkyl groups of up to 20 carbon atoms, alkenyl groups of up to 20 carbon atoms, and aryl groups of up to 14 carbon atoms; or $R^1$ and $R^2$ together and/or $R^3$ and $R^4$ together may represent the necessary atoms to complete a 5-, 6-, or 7-membered heterocyclic ring group; or one or more of $R^1$ to $R^4$ may represent the atoms necessary to complete a 5- or 6-membered heterocyclic ring group fused to the phenyl ring on which the $NR^1R^2$ or $NR^3R^4$ group is attached;

$R^5$ and $R^6$ are each independently selected from the group consisting of hydrogen atoms, alkyl groups of up to 20 carbon atoms, aryl groups of up to 20 carbon atoms, heterocyclic ring groups comprising up to 6 ring atoms, carbocyclic ring groups comprising up to 6 ring carbon atoms, and fused ring and bridging groups comprising up to 14 ring atoms; and $X^{31}$ is an anion; in association with a thermal carbanion-generating agent of general formula II:

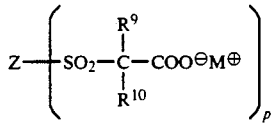

wherein:

each of $R^9$ and $R^{10}$ are individually selected from: hydrogen, an alkyl group, an alkenyl group, a cycloalkyl group, an aralkyl group, an aryl group, and a heterocyclic group, and preferably, both $R^9$ and $R^{10}$ represent hydrogen;

p is one or two, and when p is one, Z is a monovalent group selected from: an alkyl group, a cycloalkyl group, an alkenyl group, an alkynyl group, an aralkyl group, an aryl group, and a heterocyclic group, and when p is two, Z is a divalent group selected from: an alkylene group, a cycloalkylene group, an alkenylene group, an aralkylene group, an arylene group, an alkynylene group, and a heterocyclic group; and, $M^+$ is a cation which will not react with the carbanion generated from the thermal-carbanion-generating agent in such manner as to render the carbanion ineffective as a bleaching agent for the polymethine dye. Preferably, $M^+$ is an organic cation. More preferably, $M^+$ is a quaternary-ammonium cation. Most preferably, $M^+$ is a tetra-alkylammonium cation. As used herein, the term "organic cation" means a cation whose sum total by weight of hydrogen and carbon atoms is greater than 50%, based upon the formula weight of the cation, halogen atoms being excluded from consideration.

The present invention also provides thermal-dye-bleach constructions in the form of photographic elements comprising a support bearing an electromagnetic-radiation-sensitive photographic silver halide material, and a thermal carbanion-generating agent and polymethine dye as an antihalation or acutance agent.

The present invention further provides thermal-dye-bleach construction for infrared-sensitive silver halide systems.

The present invention further provides thermal-dye-bleach constructions whose thermal-bleaching by-products are non-toxic as compared to some conventional constructions which liberate volatile, potentially toxic materials such as nitriles.

As is well understood in this area, substitution is not only tolerated, but is often advisable. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical substituent, the described chemical material includes the basic group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents bearing further substituents known in the art, such as hydroxyl, alkoxy, vinyl, phenyl, halogen atoms (F, Cl, Br, and I), cyano, nitro, amino, carboxyl, etc. On the other hand, the phrase "alkyl moiety" is limited to the inclusion of only pure open-chain and cyclic saturated hydrocarbon alkyl substituents, such as methyl, ethyl, propyl, t-butyl, cyclohexyl, adamantyl, octadecyl, and the like.

BRIEF DESCRIPTION OF THE FIGURES

FIG. **1-*a*** represents the bleaching profile of a construction employing bleaching agents of the invention.

FIG. **1-*b*** represents the bleaching profile of a construction employing bleaching agents described in U.S. Pat. No. 5,135,842.

Figure 1B:
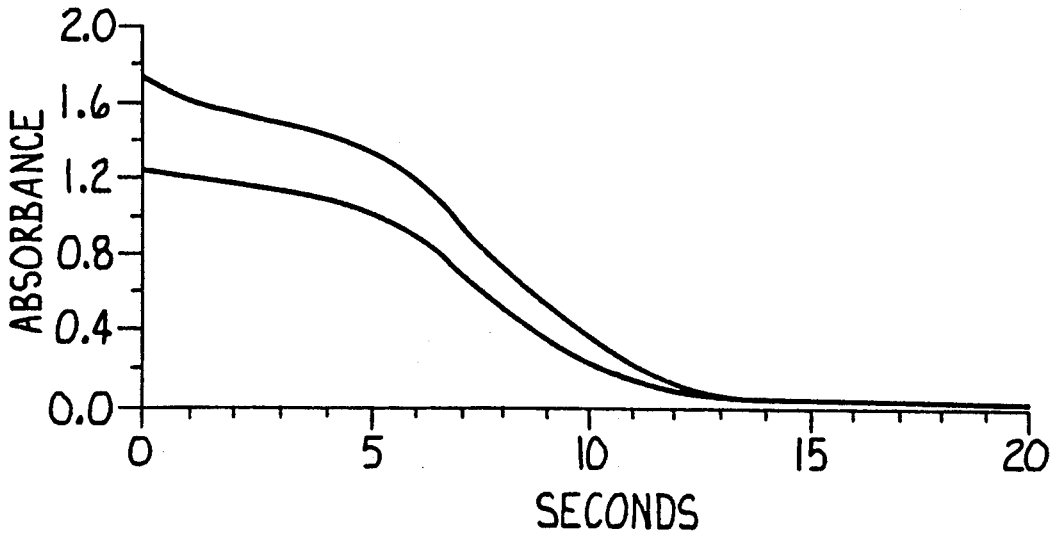

FIG. **2-*a*** represents the bleaching profile of a construction employing bleaching agents described in U.S. Pat. No. 5,135,842.

FIG. **2-*b*** represents the bleaching profile of a construction employing a mixture of bleaching agents of the invention with those of U.S. Pat. No. 5,135,842.

All figures are a plot of absorbance vs. time.

DESCRIPTION OF PREFERRED EMBODIMENTS

The Polymethine Dye

The polymethine dyes of formula I are known and are disclosed, for example, in W. S. Tuemmler and B. S. Wildi, *J. Amer. Chem. Soc.* 1958, 80, 3772; H. Lorenz and R. Wizinger, *Helv. Chem. Acta.* 1945, 28, 600; U.S. Pat. Nos. 2,813,802, 2,992,938, 3,099,630, 3,275,442, 3,436,353 and 4,547,444; and Japanese Patent No. 56-109,358. The dyes have found utility in infrared screening compositions, as photochromic materials, as sensitizers for photoconductors, and as infrared absorbers for optical data storage media. Polymethine dyes in accordance with formula I have been shown to bleach in conventional photographic processing solutions, as disclosed in EP 0,377,961, but have not previously been known to bleach by thermal carbanion generating processes.

The combination of the polymethine dye, which may be a red, far-red, or near-infrared- absorbing dye, with an agent capable of generating a carbanion upon thermolysis, e.g., a thermal-carbanion-generating agent, finds particular utility as antihalation or acutance constructions in photothermographic materials, e.g., dry silver materials, since the dyes will readily bleach during the thermal processing of the materials.

In the dyes of general formula I, W is preferably selected from: $R^1O$—, $R^1S$—, $NR^1R^2$, and $NR^3R^4$; most preferably, alkoxy, containing alkyl groups of up to 5 carbon atoms, and dialkylamino, bearing alkyl groups of up to 5 carbon atoms.

$R^1$ to $R^4$ are each independently selected from alkyl, and alkenyl groups of up to 20 carbon atoms, preferably of up to 10 carbon atoms, and most preferably of up to 5 carbon atoms and aryl groups of up to 14 carbon atoms, preferably up to 10 carbon atoms. Most often, $R^1=R^2$ and/or $R^3=R^4$ and/or $R^1=R^3$. Preferred examples of $R^1$ to $R^4$ groups are selected from methyl, ethyl, and 2-methoxyethyl groups. In addition, $R^1$ and $R^2$ together and/or $R^3$ and $R^4$ together may represent the non-metallic atoms necessary to complete a nucleus of a 5-, 6-, or 7-membered heterocyclic ring group. When completing such a ring group the atoms are generally selected from non-metallic atoms such as C, N, O, and S, and each ring group may be with one or more substituents as described above. The heterocyclic ring nuclei so completed may be any of those known in the polymethine dye art, but preferred examples include morpholine, pyrrolidine, 2-methylpiperdine, and azacycloheptane. In addition, one or more of $R^1$ to $R^4$ may represent the necessary atoms to complete a 5- or 6-membered heterocyclic ring fused to the phenyl ring on which the $NR^1R^2$ or $NR^3R^4$ group is attached. The heterocyclic ring nuclei so completed may be any of those known in the polymethine dye art, but preferred examples include 1,2-dihydroindole, 1,2,3,4-tetrahydroquinoline, and julolidine.

$R^5$ and $R^6$ are each independently selected from hydrogen atoms; alkyl groups of up to 20 carbon atoms and most preferably of up to 5 carbon atoms; and aryl groups of up to 10 carbon atoms; each of which group may be substituted by one or more substituents as described above. Additionally, when $R^5$ and/or $R^6$ represent an aryl group, then additional substituents such as W (as defined above) may be present. Preferred W include $R^1O$—, $R^1S$—, $NR^1R^2$, and $NR^3R^4$ (in which $R^1$ to $R^4$ are as defined above). Preferred examples of $R^5$ and $R^6$ are selected from hydrogen atoms, phenyl, 4-dimethylaminophenyl, 4-diethylaminophenyl, 4-bis(-methoxyethyl)aminophenyl, 4-N-pyrrolidinophenyl, 4-N-morpholinophenyl -4-N-azacycloheptyl, 4-dimethylamino-1-naphthyl, mono- and dimethoxyphenyl and, ethoxyphenyl groups. $R^5$ and $R^6$ may also represent a nucleus of a 5-, 6-, or 7-membered heterocyclic ring group in which ring atoms are selected from C, N, O, and S; a 5- or 6-membered carbocyclic ring group; or a fused ring group comprising up to 14 ring atoms selected from the group consisting of: C, N, O, and S, wherein each ring may possess one or more substituents as described above.

When the groups $R^1$ to $R^6$ are substituted, the substituents may be selected from a wide range of substituents providing they do not cause autobleaching of the dye. For example, substituents having free amino groups promote autobleaching unless the amino group is attached directly to the delocalized electron system. Generally the substituents are selected from: halogen atoms, nitro groups, hydroxyl groups, cyano groups, ether groups of up to 15 carbon atoms, thioether groups of up to 15 carbon atoms, ketone groups of up to 5 carbon atoms, aldehyde groups of up to to 5 carbon atoms, ester groups of up to 5 carbon atoms, amide groups of up to 15 carbon atoms, alkoxy groups of up to 15 carbon atoms, alkyl groups of up to 15 carbon atoms, alkenyl groups of up to 5 carbon atoms, aryl groups of up to 10 carbon atoms; and heterocyclic ring nuclei comprising up to 10 ring atoms selected from C, N, O, and S, and combinations of these substituents.

In principle, $X^-$ may be any anion that is non-reactive with the polymethine dye. Suitable anions for $X^-$ include inorganic anions such as chloride, bromide, iodide, perchlorate, tetrafluoroborate, triiodide, hexafluorophosphate, and the like. Suitable organic anions include, for example, acetate, 4-toluenesulfonate, and dodcylbenzenesulfonate, and methanesulfonate. Preferred anions for $X^-$ are those containing a perfluoroalkylsulfonyl group such as, trifluoromethanesulfonate, perfluorooctanesulfonate, and perfluoro(ethylcyclohexane)sulfonate (PECHS).

The length of the polymethine chain is determined by n which has integral values in the range of $0 \leqq n \leqq 3$ completing tri-, penta-, hepta-and nonamethine chain lengths. The polymethine chain may be unsubstituted or contain substituents. For example, alkyl groups of up to 5 carbon atoms; substituted alkyl groups of up to 5 carbon atoms; or halogen atoms may be present. The polymethine chain may contain a bridging chain such as, for example, those non-metallic atoms necessary to complete a heterocyclic ring or a fused ring system or a carbocyclic ring, each of which may possess alkyl substituents of 1 to 5 carbon atoms. Examples of bridging chains include those forming cyclohexene and cyclopentene rings.

$R^5$ and $R^6$ taken together with the polymethine chain may form a bridging ring or $R^5$ and/or $R^6$ taken with other substituents on the polymethine chain may form a ring.

In addition to the ring substituents shown in general formula I of the central dye nucleus, the dyes may possess ring substituents in other positions. Non-limiting examples include substituents suitable for the groups $R^1$ to $R^4$; Cl, Br, I, $CH_3O$—, and $CH_3S$—.

A preferred group of dyes have a nucleus of general formula III:

III

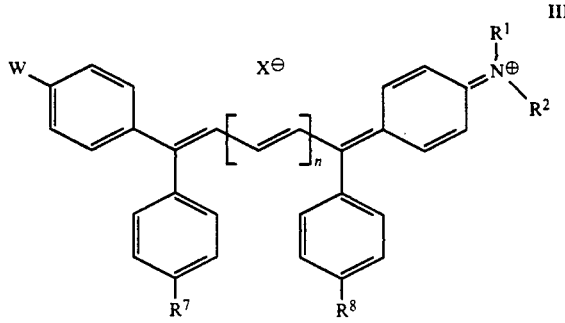

wherein:

$R^1$ to $R^4$, W, $X^-$, and n are as defined above, and, $R^7$ and $R^8$ are independently selected from W (as defined above); and hydrogen atoms. Table II (later herein) reports a series of bleachable dyes of general formula I which have been prepared. Table III (later herein) reports a series of bleachable dyes of general formula II which have been prepared.

The Carbanion Precursor

A variety of thermal carbanion precursors (i.e., thermal-carbanion-generating agents) may be used for the purposes of this invention and, in general, any carbanion precursor that effectively irreversibly generates a carbanion upon heating can be used. Carbanion precursors formed by decarboxylation of an organic acid anion (carboxylate anion) upon heating are preferred. It is further preferred that the carbanion precursor undergo decarboxylation at elevated temperatures, preferably in the range of 95°-150° C. and more preferably in the range of 115°-135° C.

Examples of carboxylic acid anions having the above-mentioned property include trichloroacetate, acetoacetate, malonate, cyanoacetate, and sulfonylacetate. It is also preferred that the carboxylate anion have a functional group that accelerates decarboxylation such as an aryl group or an arylene group. The carboxylic acid anion is preferably a sulfonylacetate anion having formula II.

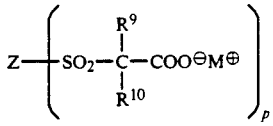

In formula II each of $R^9$ and $R^{10}$ is a monovalent group such as hydrogen, an alkyl group, an alkenyl group, a cycloalkyl group, an aralkyl group, an aryl group, and a heterocyclic group. In addition, $R^9$ and/or $R^{10}$ taken together may represent non-metallic atoms necessary to form a 5-, 6-, or 7-membered ring. Hydrogen is preferred. Each of the monovalent groups may have one or more substituent groups. Each of the alkyl and alkenyl groups preferably has from one to eight carbon atoms.

$M^+$ is a cation which will not react with the carbanion generated from the thermal-carbanion-generating agent in such manner as to render the carbanion ineffective as a bleaching agent for the dye. Thus $M^+$ may be a cation containing no labile hydrogen atoms, such as a quaternary-ammonium wherein the central atom is attached only to carbon atoms, lithium, sodium, or potassium. Compounds such as cryptands can be used to increase the solubility of the carbanion generator when $M^+$ is a metal cation. Examples of these prefrrred cations include tetra-alkylammonium cations and crown ether complexes of alkali metal cations. As used herein the term "quaternary-ammonium" further includes atoms that are in the same group in the periodic table as nitrogen. Such atoms include phosphorus, arsenic, antimony, and bismuth.

In the formula, p is one or two. When p is one, Z is a monovalent group such as an alkyl group, a cycloalkyl group, an alkenyl group, an alkynyl group, an aralkyl group, an aryl group, and a heterocyclic group. An aryl group is preferred. Each of the monovalent groups may have one or more substituent groups. The more preferred substituent groups are those having a Hammett sigma (para) value equal to or more positive than that of hydrogen (defined as zero).

When p is two, Z is a divalent group such as an alkylene group, an arylene group, a cycloalkyl group, an alkynylene group, an alkenylene group, an aralkylene group, and a heterocyclic group. Each of the divalent groups may have one or more substituent groups, an arylene group and a heterocyclic group being preferred. An arylene group is particularly preferred.

Examples of preferred phenylsulfonylcarboxylic acids are disclosed in the above-mentioned U.S. Pat. No. 4,981,965, the disclosure of which is incorporated herein by reference.

A preferred embodiment uses, as the thermal carbanion precursor, a quaternary-ammonium salt of an organic acid which decarboxylates upon heating to yield a carbanion. Preferably, the carboxylic acid anion is a phenylsulfonylacetate and bleaching of the antihalation layer is efficiently accomplished using carbanion generating compounds of formula IV.

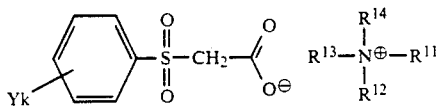

IV wherein:

$R^{11}$ to $R^{14}$ are individually $C_1$ to $C_{18}$ with the proviso that the carbon sum will not exceed 22, more preferably 15, and most preferably 10;

Y is a carbanion-stabilizing group; and k is 0–5.

In general Y may be any carbanion-stabilizing group. Preferred groups are those having a Hammett sigma (para) value $\sigma_p \geqq 0$. Such groups are exemplified by, but not limited to: hydrogen, nitro, chloro, cyano, perfluoroalkyl (e.g., trifluoromethyl), sulfonyl (e.g., benzenesulfonyl and methanesulfonyl), perfluoroalkylsulfonyl (e.g., trifluoromethanesulfonyl), and the like. The more preferred Y are those having Hammett $\sigma_p \geqq +0.5$, examples being methanesulfonyl and perfluoroalkyl. The most preferred embodiments are those that employ quaternary-ammonium salts of 4-nitrophenylsulfonylacetic acid. For a discussion of Hammett $\sigma_p$ parameters, see M. Charton, "Linear Free Energy Relationships" *Chemtech* 1974, 502–511 and *Chemtech* 1975, 245–255.

Although not wishing to be bound by theory, it is believed that upon heating, the quaternary-ammonium phenylsulfonylacetate salt decarboxylates to give carbon dioxide and a phenylsulfonylmethide anion. Addition of this stabilized anion to one of the double bonds of the dye chromophore results in effectively-irreversible disruption of conjugation in the dye and loss of color. Thus, bleaching results from addition of a carbanion derived from the anionic portion of the bleaching agent. It is also contemplated that further carbanions, etc., capable of bleaching these dyes may be formed from neutral species present in, or added to, the system; such further bleaching agents mught result from interaction of these species with the primary carbanion.

Bleaching agents such as those described in U.S. Pat. No. 5,135,842 are believed to function by a different mechanism. Those bleaching agents are derived from primary and secondary amine salts of a phenylsulfonylacetic acid. Heating of those materials results similarly in decarboxylation to give carbon dioxide and a phenylsulfonylmethide anion; however, in those materials, the anion abstracts a labile proton from the positively charged primary or secondary amine salt to form a phenylsulfonylmethane and release an amine. Addition of that amine to one of the double bonds of the dye chromophore results in disruption of conjugation in the dye and thus loss of color. Thus, bleaching results from addition of a nucleophile derived from the cationic portion of the bleaching agent; such addition may often be reversed by exposure to an acid.

Representative thermal carbanion-generating agents are shown in Table I. Representative cations are designated C1–C13 and representative anions are designated A1–A7. In general, any combination of anion with cation will be effective in these constructions.

Acid Addition

Addition of acid to the thermal-dye-bleach solution is frequently beneficial. Acid retards pre-bleaching of the dye prior to coating, during coating, and in the drying ovens; and it results in longer solution pot life, higher $D_{max}$ and improved shelf life of the thermally bleachable coatings. The acid may be added to the polymer solution directly. Preferably, the acid is a carboxylic acid or a phenylsulfonylacetic acid. Phenylsulfonylacetic acids having strongly electron withdrawing groups on the phenyl ring are particularly preferred. Representative acids are acids corresponding to acidification (i.e., protonation) of anions A1–A7. In practice use of the free acid of the anion used in the thermal-carbanion-generating salt is convenient. As shown in Examples 33 and 34 herein, the $D_{max}$ of the solutions prepared with acid stabilizer are higher than those of the solutions prepared without acid stabilizer.

The molar ratio of acid to carbanion-generator is not thought to be unduly critical, but usually an excess of acid is used. A mole ratio between about 1/1 to about 5/1 is preferred.

The molar ratio of acid to dye is also not thought to be particularly critical, but usually an excess of acid is present. A ratio from about 1/1 to about 4/1 is preferred.

The molar ratio of thermal-carbanion-generator to dye is also not thought to be particularly critical. If used alone, it is important that the molar amount of carbanion-generator be greater than that of the dye. A ratio from about 2/1 to about 5/1 is preferred. When used in conjunction with an amine-releaser, a ratio of less than 1/1 may be used as long as the total molar ratio of combined bleaching agents to dye is greater than 1/1.

In some cases, an isolable complex, V below, of a quarternary-ammonium-phenylsulfonate and a phenylsulfonylacetic acid may be prepared and utilized. The thermal-carbanion-generating agents descrobed by V can be prepared readily by reacting in solution one mole of quaternary ammonium hydroxide with two moles of carboxylic acid or by treating a solution of the (one-to-one) quaternary ammonium salt with a second equivalent of acid. These "acid-salts" are often stable crystalline solids which are easily isolated and purified. When these compounds are heated they decarboxylate to generate an organic base in the form of a carbanion. By varying the structure of $R^{11}$ to $R^{14}$ as well as by varying the substituent groups on the phenyl ring, a variety of salts may be obtained. Thus, it is possible to modify the solubility and reactivity characteristics of the carbanion-generator salt.

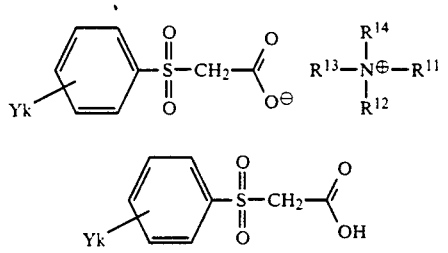

V wherein $R^{11}$ to $R^{14}$, Y, and k are as defined earlier herein.

Use in Cooperation with Other Bleaching Agents

Thermal-dye-bleach constructions employing thermal-carbanion-generating agents of the invention, such as those described in Table I (later herein), exhibit improved shelf life and more rapid bleaching over a narrow temperature range than those described in above mentioned U.S. Pat. No. 5,135,842. However, the bleached construction resulting from reaction of the phenylsulfonylmethide carbanion with the polymethine dye is slightly yellow. For many constructions, this is not a problem.

It has also been found that the combination of a thermal carbanion-generating agent of this invention with amine salts, such as those described in the abovementioned U.S. Pat. No. 5,135,842, bleaches the polymethine dyes to colorless product. The combination of bleaching agents maintains the improved shelf life and rapid bleaching over a narrow temperature range characteristic of the thermal-carbanion-generating agents. In addition, accelerated aging tests, conducted at 80° F./80% relative humidity, indicate that the combination of thermal-carbanion-generating agent with an amine salt has improved stability compared with thermal-dye-bleach constructions containing only amine salts as the thermal-dye-bleach agent.

Figure 1A:
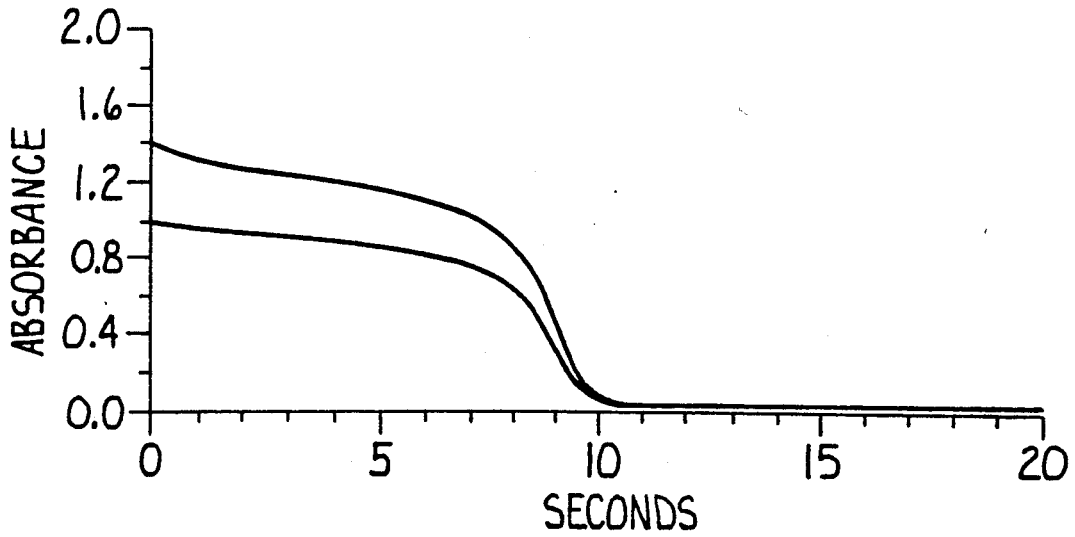

FIG. 1 compares the rates of bleaching of thermal-dye-bleach constructions containing quaternary-ammonium salts used in the present invention (FIG. 1*a*) with thermal-dye-bleach constructions containing guanidinium salts (a type of amine salt) disclosed in U.S. Pat. No. 5,135,842 (FIG. 1*b*). Constructions containing quaternary-ammonium salts used in the present invention bleach more rapidly and over a narrower temperature range than constructions containing guanidinium salts.

Figure 2A:
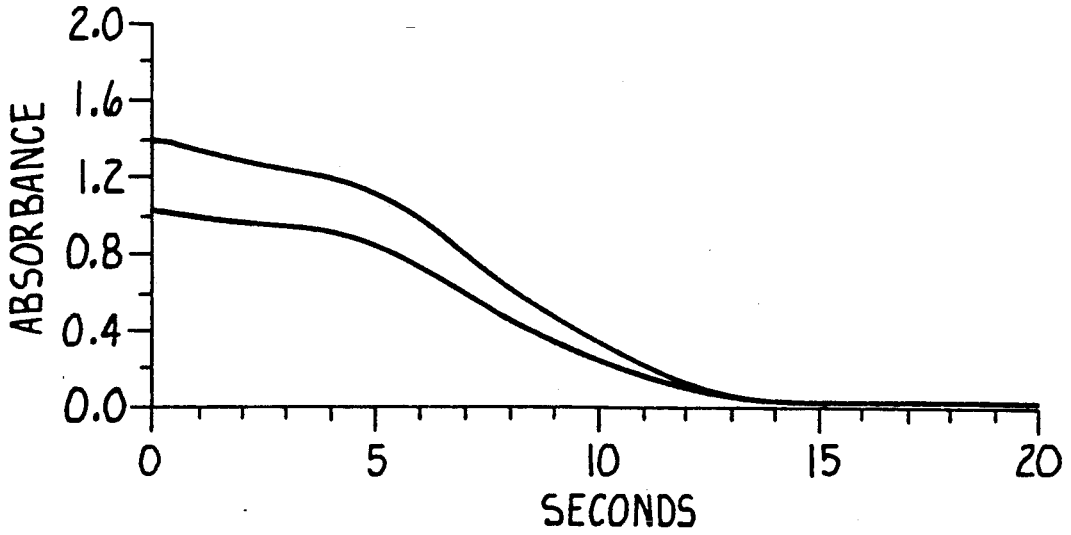
Figure 2B:
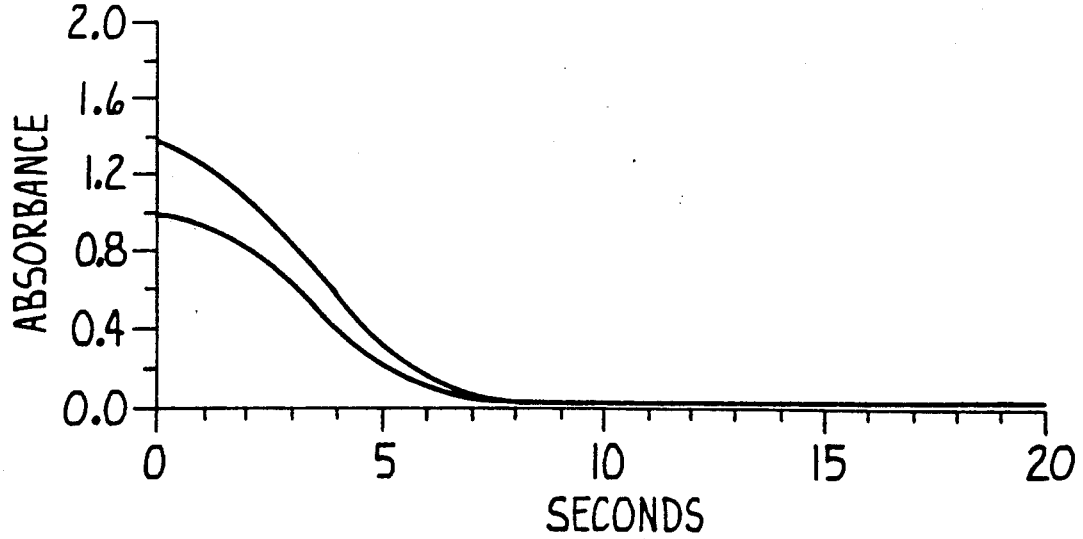

FIG. 2 compares the rates of bleaching of thermal-dye-bleach constructions containing both quaternary-ammonium salts used in the present invention and guanidinium salts (FIG. 2*b*) with thermal-dye-bleach constructions containing only guanidinium salts disclosed in U.S. Pat. No. 5,135,842 (FIG. 2*a*). Constructions containing both quaternary-ammonium salts and guanidinium salts used in the present invention exhibit more rapid bleaching over a narrower temperature range than constructions containing only guanidinium salts.

Thermal Bleaching Constructions

The polymethine dye of structure I or III and the thermal carbanion generating agent of structure II or IV are usually coated together with an organic binder as a thin layer on a substrate. The polymethine dyes are generally included in antihalation layers to provide a transmissive optical density of greater than 0.1 at λmax of the dye. Generally the coating weight of dye which will provide the desired effect is from 0.1 to 1.0 mg/dm$^2$.

The heat-bleachable construction thus formed may be used as an antihalation coating for photothermography or it may be used directly as a thermographic material. The type of photothermographic medium used in the invention is not critical. Examples of suitable photothermographic media include dry silver systems (see, for example U.S. Pat. No. 3,457,075) and diazo systems.

When used as an acutance, antihalation, or filter dye, it is preferred to incorporate compounds of formulae I or III in an amount sufficient to provide an optical density of from 0.05 to 3.0 absorbance units. The coating weight of the dye is generally from 0.001 to 1 g/m$^2$, preferably 0.001 to 0.05 g/m$^2$. When used for antihalation purposes, the dye must be present in a layer separate from the silver halide layer(s). The antihalation layer(s) may be positioned either above or below the silver halide layer(s), and if the support is transparent, an antihalation layer may be positioned on the surface of the support opposite the silver halide-containing layer(s). For acutance purposes, the compounds of formulae I or III are incorporated within the silver halide-containing layer(s). When used for filter purposes, the compounds of formulae I or III are normally incorporated in a layer separate from and positioned above the silver halide-containing layer(s).

A wide variety of polymers are suitable for use as the binder in the heat-bleachable construction. The activity of the thermal-dye-bleach layer may be adjusted by suitable choice of polymeric binder, and thermal-dye-bleach layers with a wide variety of decolorization temperatures may be prepared. In general, polymeric binders of lower glass transition temperatures ($T_g$) produce thermal-dye-bleach constructions with greater reactivity.

TABLE I

Representative Carbanion Precursors

| | |
|---|---|
| Cations | |
| Tetramethylammonium$^+$ | C1 |
| Tetraethylammonium$^+$ | C2 |
| Tetrapropylammonium$^+$ | C3 |
| Tetrabutylammonium$^+$ | C4 |
| Benzyltrimethylammonium$^+$ | C5 |
| Li-12-Crown-4$^+$ | C6 |
| Na-15-Crown-5$^+$ | C7 |
| K-Dibenzo-18-Crown-6$^+$ | C8 |
| K-18-Crown-6$^+$ | C9 |
| Tetraphenyl phosphonium$^+$ | C10 |
| Tetraphenyl arsonium$^+$ | C11 |
| N-Dodecyl pyridinium$^+$ | C12 |
| Dodecyltrimethylammonium$^+$ | C13 |
| Anions | |
| 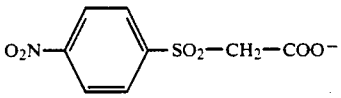 | $A^1$ |
| 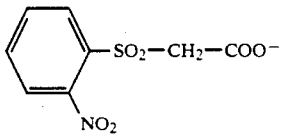 | $A^2$ |
| 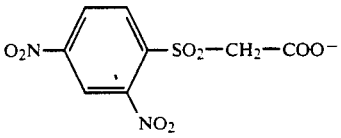 | $A^3$ |
| 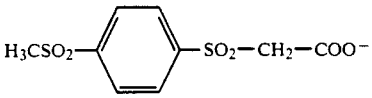 | $A^4$ |
| 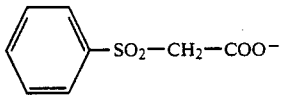 | $A^5$ |
| 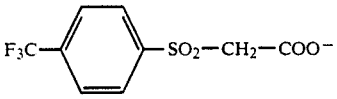 | $A^6$ |
| 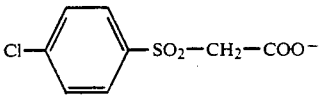 | $A^7$ |

EXAMPLES

As the following examples show, according to the present invention there is defined a class of thermal-dye-bleach constructions comprising a thermal carbanion-generating agent in association with a polymethine dye.

Preparation of Quaternary-ammonium Phenylsulfonylacetate Salts

EXAMPLE 1

Preparation of tetramethylammonium 4-nitrophenylsulfonylacetate (C1-A1)

Into a 100 ml flask equipped with magnetic stirrer were placed 2.45 g (0.01 mol) of 4-nitrophenylsulfonylacetic acid and 50 ml of acetone. Stirring was begun and upon dissolution of the acid, 4.0 g of a 25% methanolic solution (i.e., 1.00 g, 0.011 mol) of tetramethylammonium hydroxide was slowly added, dropwise over a 15 min period. A precipitate formed in the dark red solution. Filtration, washing with acetone (10 ml) and drying in air afforded 2.9 g (91%) of tetramethylammonium 4-nitrophenylsulfonylacetate (Compound C1-A1). $^1H$ and $^{13}C$ NMR were in agreement with the proposed structure.

EXAMPLE 2

Preparation of other quaternary ammonium 4-nitrophenylsulfonylacetate salts

In a manner similar to that above, the following quaternary ammonium 4-nitrophenylsulfonylacetates were prepared.

Tetraethylammonium 4-nitrophenylsulfonylacetate (Compound C2-A1)—from tetraethylammonium hydroxide and 4-nitrophenylsulfonylacetic acid.

Tetrabutylammonium 4-nitrophenylsulfonylacetate (Compound C4-A1)—from tetrabutylammonium hydroxide and 4-nitrophenylsulfonylacetic acid.

Tetramethylammonium 4-(trifluoromethyl)phenylsulfonylacetate (Compound C1-A6)—from tetramethylammonium hydroxide and 4-(trifluoromethyl)-phenylsulfonylacetic acid.

Tetramethylammonium 4-chlorophenylsulfonylacetate (Compound C1-A7)—from tetramethylammonium hydroxide and 4-chlorophenylsulfonylacetic acid.

EXAMPLE 3

Preparation of "Acid-Salts"

As noted above, "acid-salts" described by V can be readily prepared by treating one mole of quaternary ammonium or other hydroxide with two moles of carboxylic acid or by treating a solution of neutral quaternary ammonium hydroxide or other salt with a second equivalent of acid. The materials are typically stable crystalline salts which are easy to isolate and purify. When these compounds are heated they decarboxylate and generate an organic carbanion.

Various of salts have been obtained which exhibit a range of solubility. This gives them utility in a range of constructions and compatibility with various thermal-dye-bleach systems.

A solution of 24.5 g (0.10 mol) of 4-nitrophenylsulfonylacetic acid in 200 ml of acetone was prepared by stirring and filtration to remove some material that did not go into solution. To the filtered solution was added 16.8 g of 25% tetramethylammonium hydroxide (i.e., 4.2 g, 0.046 mol) in methanol. Upon completion of the addition, the solution turned orange and a precipitate formed. Filtration, washing with 50 ml of methanol and 100 ml of acetone, and drying afforded 21.3 g (82%) of tetramethylammonium 4-nitrophenylsulfonylacetate/4-nitrophenylsulfonylacetic acid "acid-salt." Composition of the salts were confirmed using $^{13}C$ NMR spectroscopy.

In a similar manner, other "acid-salts" were obtained. Reaction solvents were changed to accommodate solubility of the specific salt.

Preparation and Use of Heat-Bleachable Formulations

EXAMPLES 4–37 DEMONSTRATE THE USE OF QUATERNARY-AMMONIUM PHENYLSULFONYLACETATE BLEACHING AGENTS WITH POLYMETHINE DYES

EXAMPLES 4–34

Typical heat-bleachable antihalation formulations were prepared as described below.

Solution A: A solution of Eastman cellulose acetate butyrate (CAB 381-20), Goodyear polyester (PE-200), 2-butanone, toluene, or 4-methyl-2-pentanone was prepared.

Solution B: When used, a solution of substituted-phenylsulfonylacetic acid in acetone or methanol was prepared.

Solution C: A solution of polymethine dye of formula I or III in acetone or methanol was prepared.

Solution D: A solution of thermal carbanion generating salt or "acid-salt" in acetone, methanol, and/or dimethylformamide (DMF) was prepared.

Solution E: When used, a solution of guanidinium thermal-nucleophile-generating agent in methanol or dimethylformamide (DMF) was prepared.

The resulting polymer, dye, and thermal-carbanion-generator, and amine-releaser solutions were combined and mixed thoroughly and coated onto a polyester substrate using a knife coater. The wet coating thickness was 3 mil (76 μm). The coating was dried 4 minutes at 180° F. (82° C.). The substrate was either a clear or white opaque polyester. Absorbances were obtained using a Hitachi Model 110-A Spectrophotometer in either transmittance or reflectance mode.

The constructions were bleached by running them through a 3M Model 9014 Dry Silver Processor. The temperature was 260°–265° F. (127°–129° C.) and dwell time was 10 seconds.

EXAMPLES 4–5

Examples 4 and 5 demonstrate the use of the quaternary-ammonium carbanion generator C1-A1 as a bleaching agent. Two concentrations of this material were used. Antihalation coating formulations were prepared as follows:

| Material | Ex. 4 | Ex. 5 |
|---|---|---|
| Solution A: | | |
| Cellulose Acetate Butyrate (CAB) | 0.6139 g | 0.6139 g |
| Goodyear PE-200 Polyester | 0.0086 g | 0.0086 g |
| 2-Butanone | 4.3113 g | 4.3113 g |
| Toluene | 2.0962 g | 2.0962 g |
| Solution C: | | |
| Dye D5 | 0.0064 g | 0.0128 g |
| Methanol | 2.2540 g | 2.2540 g |
| Solution D: | | |
| Carbanion Generator C1-A1 | 0.0064 g | 0.0128 g |
| Methanol | 0.3500 g | 0.3500 g |
| Dimethylformamide | 0.3500 g | 0.3500 g |

The solutions were mixed and coated at 3 mil (76 μm) wet thickness and dried at 180° F. (82° C.) for 4 minutes. Upon running through a 3M Model 9014 Thermal Processor at 260° F. (127° C.) for 10 seconds, both coatings were completely bleached.

EXAMPLE 6

Example 6 demonstrates the use of acid in the bleaching construction in addition to quaternary-ammonium carbanion-generator as a bleaching agent. As noted above, acid retards pre-bleaching of the dye prior to coating, during coating, and in the drying ovens; and results in longer solution pot life, higher $D_{max}$ of the coated material, and improved shelf life of the thermally bleachable coatings. In a manner similar to that above, the following antihalation coating solution was prepared:

| Material | Ex. 6 |
|---|---|
| Solution A: | |
| Cellulose Acetate Butyrate (CAB) | 0.4220 g |
| Goodyear PE-200 Polyester | 0.0059 g |
| 2-Butanone | 2.9637 g |
| Toluene | 1.4410 g |
| 4-methyl-2-pentanone | 0.4830 g |
| 4-Nitrophenylsulfonylacetic acid | 0.0458 g |
| Solution C: | |
| Dye D15 | 0.0130 g |
| Methanol | 0.9300 g |
| Solution D: | |
| Carbanion Generator C1-A1 | 0.0305 g |
| Methanol | 4.0860 g |

The solution was coated at 3 mil (76 μm) wet thickness and dried at 180° F. (82° C.) for 4 minutes. The coating had an absorbance of 0.56 at 638 nm. Upon running through a 3M Model 9014 Thermal Processor at 260° F. (127° C.) for 10 seconds, the coating bleached from intense cyan to colorless. The coating had no measurable absorbance at 638 nm.

EXAMPLE 7

Example 7 demonstrates the use of the thermal-carbanion-generator tetramethylammonium 4-(trifluoromethyl)phenylsulfonylacetate (Compound C1-A6) as a bleaching agent. This example also demonstrates the use of an acid to stabilize the system. An antihalation coating formulation was prepared as follows:

| Material | Ex. 7 |
|---|---|
| Solution A: | |
| Cellulose Acetate Butyrate (CAB) | 0.5239 g |
| Goodyear PE-200 Polyester | 0.0073 g |
| 2-butanone | 3.6794 g |
| Toluene | 1.7890 g |
| Solution B: | |
| 4-(trifluoromethyl)phenylsulfonylacetic acid | 0.0191 g |
| Acetone | 1.5477 g |
| Solution C: | |
| Dye D5 | 0.0273 g |
| Acetone | 1.9270 g |
| Solution D: | |
| Carbanion Generator C1-A6 | 0.0380 g |
| Methanol | 1.5338 g |
| Dimethylformamide | 2.9800 g |

The solutions were mixed and coated at 3 mil (76 μm) wet thickness and dried at 180° F. (82° C.) for 4 minutes. The absorbance at 820 nm was 1.15. Upon running through a 3M Model 9014 Thermal Processor at 260° F. (127° C.) for 10 seconds, complete bleaching was obtained. The coating had no measurable absorbance at 820 nm.

EXAMPLE 8

In a manner similar to that above, the following solutions were prepared:

| Material | Ex. 8 |
|---|---|
| Solution A: | |
| Cellulose Acetate Butyrate (CAB) | 0.5239 g |
| Goodyear PE-200 Polyester | 0.0073 g |
| 2-Butanone | 3.6794 g |
| Toluene | 1.7890 g |
| 4-Methyl-2-pentanone | 0.6000 g |
| Solution B: | |
| 4-Nitrophenylsulfonylacetic acid | 0.0156 g |
| Methanol | 0.6328 g |
| Dimethylformamide | 0.6328 g |
| Solution C: | |
| Dye D5 | 0.0273 g |
| Methanol | 0.9635 g |
| Dimethylformamide | 0.9635 g |
| Solution D: | |
| Carbanion Generator C1-A1 | 0.0156 g |
| Methanol | 0.6328 g |
| Dimethylformamide | 0.6328 g |

The solution was coated on polyester at 3 mil (76 μm) wet thickness and dried at 180° F. (82° C.) for 4 minutes. The absorbance at 780 nm was 0.94. Upon running through a 3M Model 9014 Thermal Processor at 260° F. (127° C.) for 10 seconds, complete bleaching was obtained.

EXAMPLE 9

The following example demonstrates the use of non-labile-hydrogen-containing monovalent cations as the cation portion of the carbanion generators. The carbanion generator was dibenzo-18-crown-6-potassium 4-nitrophenylsulfonylacetate (C8-A1). Antihalation coating formulations were prepared as follows:

| Material | Ex. 9 |
|---|---|
| Solution A: | |
| Cellulose Acetate Butyrate (CAB) | 0.5239 g |
| Goodyear PE-200 Polyester | 0.0073 g |
| 2-butanone | 3.6794 g |
| Toluene | 1.7890 g |
| Solution B: | |
| 4-nitrophenylsulfonylacetic acid | 0.0419 g |
| Acetone | 1.7910 g |
| Solution C: | |
| Dye D5 | 0.0273 g |
| Acetone | 1.9270 g |
| Solution D: | |
| Carbanion Generator C8-A1 | 0.0368 g |
| Methanol | 2.9800 g |
| Dimethylformamide | 2.9800 g |

The solutions were mixed and coated at 3 mil (76 μm) wet thickness and dried at 180° F. (82° C.) for 4 minutes. The absorbance at 820 nm was 1.14. Upon running through a 3M Model 9014 Thermal Processor at 260° F. (127° C.) for 10 seconds, complete bleaching was obtained. The coating had no measurable absorbance at 820 nm.

EXAMPLES 10a–11a

The following examples compare the use of ammonium phenylsulfonylacetate salts having a labile hydrogen atom and described in U.S. Pat. No. 5,135,842 (Example 10a) with those of the quaternary-ammonium phenylsulfonylacetic acid salts of the present invention (Example 11a).

In a manner similar to that above, the following solutions were prepared:

| Material | Ex. 10a | Ex. 11a |
|---|---|---|
| Solution A: | | |
| Cellulose Acetate Butyrate (CAB) | 0.5239 g | 0.5239 g |
| Goodyear PE-200 Polyester | 0.0073 g | 0.0073 g |
| 2-Butanone | 3.6794 g | 3.6794 g |
| Toluene | 1.7890 g | 1.7890 g |
| 4-methyl-2-pentanone | 0.6000 g | 0.6000 g |
| Solution B: | | |
| 4-Nitrophenylsulfonylacetic acid | 0.0191 g | 0.0419 g |
| Methanol | 0.7730 g | 1.6996 g |
| Dimethylformamide | 0.7730 g | 1.6996 g |
| Solution C: | | |
| Dye D5 | 0.0273 g | 0.0273 g |
| Methanol | 0.9635 g | 0.9635 g |
| Dimethylformamide | 0.9635 g | 0.9635 g |
| Solution D: | | |
| guanidinium 4-nitrophenylsulfonylacetate | 0.0191 g | |
| Carbanion Generator C1-A1 | | 0.0182 g |
| Methanol | 0.7730 g | 0.7367 g |
| Dimethylformamide | 0.7730 g | 0.7367 g |

The solutions were coated at 3 mil (76 μm) wet thickness and dried at 180° F. (82° C.) for 4 minutes. Upon running through a 3M Model 9014 Thermal Processor at 260° F. (127° C.) for 10 seconds, complete bleaching was obtained.

A sample of unprocessed material was placed in a constant temperature/humidity room at 80° F./80% (27° C.) relative humidity for aging. The following absorbance changes were found:

| Absorbance at 780 nm | Ex. 10a | Ex. 11a |
|---|---|---|
| initial | 1.13 | 0.84 |
| 5 weeks | 0.77 | 0.75 |
| 7 weeks | 0.32 | 0.42 |

The results indicate that Example 11a had less fade with time on storage.

EXAMPLES 10b–11b

Samples were prepared in an identical manner to those of Examples 10 and 11 above. The samples were heated and their bleaching profiles monitored at both 780 nm and at 820 nm on an Hewlett-Packard Model HP 8452-A Diode Array Spectrophotometer. FIG. 1*a* shows the bleaching profile of Example 11b which contains tetramethylammonium 4-nitrophenylsulfonylacetate. FIG. 1*b* shows the bleaching profile of Example 10b which contains guanidinium 4-nitrophenylsulfonylacetate. The bleaching profile of Example 11b is much sharper than that of Example 10b.

EXAMPLES 12a–13a

As noted above, although quaternary-ammonium phenylsulfonylacetic acid salts completely bleach the constructions at the wavelength of maximum absorption, they result in a yellow tint to the bleached construction. These examples show that inclusion of guanidinium 4-nitrophenylsulfonylacetate along with the quaternary-ammonium phenylsulfonylacetic acid salts results in complete bleaching at 400 nm as well as over the absorption region of the dye. The sharp bleaching profile characteristic of the quaternary-ammonium salts is maintained.

| Material | Ex. 10a | Ex. 11a |
|---|---|---|
| Solution A: | | |
| Cellulose Acetate Butyrate (CAB) | 0.5239 g | 0.5239 g |
| Goodyear PE-200 Polyester | 0.0073 g | 0.0073 g |
| 2-Butanone | 3.6794 g | 3.6794 g |
| Toluene | 1.7890 g | 1.7890 g |
| 4-Methyl-2-pentanone | 0.6000 g | 0.6000 g |
| Solution B: | | |
| 4-Nitrophenylsulfonylacetic acid | 0.0191 g | 0.0191 g |
| Methanol | 0.7730 g | 0.7730 g |
| Dimethylformamide | 0.7730 g | 0.7730 g |
| Solution C: | | |
| Dye D5 | 0.0273 g | 0.0273 g |
| Methanol | 0.9635 g | 0.9635 g |
| Dimethylformamide | 0.9635 g | 0.9635 g |
| Solution D: | | |
| Carbanion Generator C1-A1 | 0.0000 g | 0.0053 g |
| Methanol | 0.0000 g | 0.2140 g |
| Dimethylformamide | 0.0000 g | 0.2140 g |
| Solution E: | | |
| Guanidinium 4-nitrophenylsulfonylacetate | 0.0191 g | 0.0141 g |
| Methanol | 0.7730 g | 0.5706 g |
| Dimethylformamide | 0.7730 g | 0.5706 g |
| The mole ratios of the dye and bleaching agents are noted below. | | |
| Dye | 1.0000 | 1.0000 |
| Guanidinium Salt | 1.3594 | 1.0000 |
| Anion Generator C1-A1 | 0.0000 . | 0.3594 |

The solutions were coated at 3 mil (76 μm) thick and dried at 180° F. (82° C.) for 4 minutes. The coated materials were run through a 3M Model 9014 Thermal Processor. Both samples bleached to colorless at an absorbance of 0.00 at 400 nm and had no apparent yellow color.

EXAMPLES 12b–13b

Samples were prepared in an identical manner to those of Examples 12 and 13 above. The samples were heated and their bleaching profiles monitored at both 780 nm and at 820 nm on an Hewlett-Packard Model HP 8452-A Diode Array Spectrophotometer. FIG. 2*a* shows the bleaching profile of Example 12b which contains only guanidinium 4-nitrophenylsulfonylacetate. FIG. 2*b* shows the bleaching profile of Example 13b which contains tetramethylammonium 4-nitrophenylsulfonylacetate in addition to guanidinium 4-nitrophenylsulfonylacetate. The bleaching profile of Example 13b is much sharper than that of Example 12b.

EXAMPLES 14–15

The following examples demonstrate the use of "acid-salts" as carbaniongenerators along with the use of acid. Two levels of acid were used. In a manner similar to that above, the following solutions were prepared.

| Material | Ex. 14 | Ex. 15 |
|---|---|---|
| Solution A: | | |
| Cellulose Acetate Butyrate (CAB) | 0.5239 g | 0.5239 g |
| Goodyear PE200 Polyester | 0.0073 g | 0.0073 g |
| 2-Butanone | 3.6794 g | 3.6794 g |
| Toluene | 1.7890 g | 1.7890 g |
| 4-Methyl-2-pentanone | 0.6000 g | 0.6000 g |
| Solution B | | |
| 4-Nitrophenylsulfonylacetic acid | 0.0175 g | 0.0129 g |
| Methanol | 0.7070 g | 0.8840 g |
| Dimethylformamide | 0.7070 g | 0.8840 g |
| Solution C | | |

-continued

| Material | Ex. 14 | Ex. 15 |
|---|---|---|
| Dye D5 | 0.0273 g | 0.0273 g |
| Methanol | 0.9635 g | 0.9635 g |
| Dimethylformamide | 0.9635 g | 0.9635 g |
| Solution D: | | |
| Carbanion Generator C1-A1:4-nitrophenylsulfonylacetic acid "acid-salt" | 0.0351 g | 0.0351 g |
| Methanol | 1.4170 g | 1.4170 g |
| Dimethylformamide | 1.4170 g | 1.4170 g |

The solutions were mixed and coated at 3 mil (76 μm) wet thickness and dried at 180° F. (82° C.) for 4 minutes. The absorbances at 780 nm were:

| | |
|---|---|
| 0.90 | 0.82 |

The coatings were processed at 260° F. (127° C.) for 10 seconds. The absorbances of the bleached coatings were 0.00 at 780 nm.

EXAMPLE 16

The following examples demonstrate the use of "acid-salts" in cooperation with the guanidinium salts described in U.S. Pat. No. 5,135,842. In a manner similar to that above, the following solutions were prepared:

| Material | Ex. 16 |
|---|---|
| Solution A: | |
| Cellulose Acetate Butyrate (CAB) | 0.5239 g |
| Goodyear PE-200 Polyester | 0.0073 g |
| 2-pentanone | 3.6794 g |
| Toluene | 1.7890 g |
| Solution B: | |
| 4-Nitrophenylsulfonylacetic acid | 0.0310 g |
| Acetone | 2.5123 g |
| Solution C: | |
| Dye D5 | 0.0273 g |
| Acetone | 1.9270 g |
| Solution D: | |
| Carbanion Generator C1-A1:4-nitrophenylsulfonylacetic acid "acid-salt" | 0.0113 g |
| Methanol | 0.9112 g |
| Solution E: | |
| Guanidinium 4-nitrophenylsulfonyl acetate | 0.0150 g |
| Methanol | 0.6063 g |
| Dimethylformamide | 0.6063 g |

The solutions were mixed and coated at 3 mil (76 μm) wet thickness and dried at 180° F. (82° C.) for 4 minutes. Upon running through a 3M Model 9014 Thermal Processor at 260° F. (127° C.) for 10 seconds complete bleaching was obtained. The construction exhibited a sharp bleaching profile.

A sample of unprocessed material was placed in a constant temperature/humidity room at 80° F./80% (27° C.) relative humidity for aging. The following absorbance changes were found.

| Absorbance at 780 nm | Ex. 16 |
|---|---|
| initial | 0.88 |
| 5 weeks | 0.70 |

The rate of density loss is similar to that of the tetramethylammonium salt construction of Example 11 and much improved over the guanidinium salt of Example 10.

EXAMPLES 17-19

The following experiments demonstrate the use of various quaternary-ammonium "acid-salts" in thermal-dye-bleach constructions. In a manner similar to that above, the following solutions were prepared:

| Material | Ex. 17 | Ex. 18 | Ex. 19 |
|---|---|---|---|
| Solution A: | | | |
| Cellulose Acetate Butyrate (CAB) | 0.5239 g | 0.5239 g | 0.5239 g |
| Goodyear PE-200 Polyester | 0.0073 g | 0.0073 g | 0.0073 g |
| 2-butanone | 3.6794 g | 3.6794 g | 3.6794 g |
| Toluene | 1.7890 g | 1.7890 g | 1.7890 g |
| 4-methyl-2-pentanone | 0.6000 g | 0.6000 g | 0.6000 g |
| Solution B: | | | |
| 4-Nitrophenylsulfonylacetic acid | 0.0191 g | 0.0191 g | 0.0191 g |
| Acetone | 1.5460 g | 1.5460 g | 1.5460 g |
| Solution C: | | | |
| Dye D5 | 0.0273 g | 0.0273 g | 0.0273 g |
| Acetone | 1.9270 g | 1.9270 g | 1.9270 g |
| Solution D: | | | |
| Carbanion Generator C2-A1 | 0.0336 g | | |
| Carbanion Generator C5-A1 | | 0.0343 g | |
| Carbanion Generator C3-A1 | | | 0.0363 g |
| Acetone | 2.7300 g | 2.7800 g | 2.9500 g |

The solutions were mixed and coated 3 at mil (76 μm) wet thickness and were dried at 180° F. (82° C.) for 4 minutes. Upon running through a 3M Model 9014 Thermal Processor at 260° F. (127° C.) for 10 seconds, the constructions appeared colorless and exhibited an absorbance of 0.02-0.04 at 400 nm. The bleaching profiles of the coatings matched those of the tetramethylammonium salt.

EXAMPLES 20-30

Examples 20-30 demonstrate the use of dyes of structures I and III in thermal-dye-bleach constructions. Antihalation coating formulations were prepared as follows:

| | Material | Ex. 20-30 |
|---|---|---|
| | Solutions A, B, and D were prepared for each dye. | |
| | Solution A: | |
| | Cellulose Acetate Butyrate (CAB) | 0.5239 g |
| | Goodyear PE-200 Polyester | 0.0073 g |
| | 2-butanone | 3.6794 g |
| | Toluene | 1.7890 g |
| | Solution B: | |
| | 4-nitrophenylsulfonylacetic acid | 0.0419 g |
| | Acetone | 1.7910 g |
| | Solution C: | |
| Ex. | The following dye solutions were prepared: | |
| 20. | Dye D1 | 0.0271 g in 1.915 g of acetone |
| 21. | Dye D2 | 0.0294 g in 2.073 g of acetone |
| 22. | Dye D5 | 0.0273 g in 1.927 g of acetone |
| 23. | Dye D6 | 0.0279 g in 1.969 g of acetone |
| 24. | Dye D7 | 0.0350 g in 2.473 g of acetone |
| 25. | Dye D8 | 0.0367 g in 2.594 g of acetone |
| 26. | Dye D9 | 0.0393 g in 2.772 g of acetone |
| 27. | Dye D10 | 0.0336 g in 2.372 g of acetone |
| 28. | Dye D11 | 0.0421 g in 2.970 g of acetone |
| 29. | Dye D12 | 0.0375 g in 2.645 g of acetone |
| 30. | Dye D14 | 0.0413 g in 2.918 g of acetone |
| | Solution D: | |
| | Carbanion Generator C1-A1 | 0.0182 g |
| | Methanol | 1.4730 g |
| | Dimethylformamide | 2.9800 g |

The solutions were mixed, coated at 3 mil (76 μm) wet thickness, and dried at 180° F. (82° C.) or 4 minutes. The absorbances in the near-infrared are shown below. Upon running through a 3M Model 9014 Thermal Processor at 260° F. (127° C.) for 10 seconds complete bleaching was obtained. The coatings had no measurable absorbance in the near-infrared.

| Ex. | Dye | λmax | Absorbance | Absorbance after Processing |
|---|---|---|---|---|
| 20. | Dye D1 | 850 nm | 0.15 | 0.00 |
| 21. | Dye D2 | 800 nm | 0.18 | 0.00 |
| 22. | Dye D5 | 830 nm | 1.8 | 0.00 |
| 23. | Dye D6 | 815 nm | 1.84 | 0.00 |
| 24. | Dye D7 | 815 nm | 1.58 | 0.00 |
| 25. | Dye D8 | 830 nm | 2.10 | 0.00 |
| 26. | Dye D9 | 805 nm | 1.38 | 0.00 |
| 27. | Dye D10 | 830 nm | 1.38 | 0.00 |
| 28. | Dye D11 | 830 nm | 0.10 | 0.00 |
| 29. | Dye D12 | 830 nm | 1.40 | 0.00 |
| 30. | Dye D14 | 830 nm | 1.84 | 0.00 |

EXAMPLE 31

This example describes the use of the coating of Example 8 as a potential thermographic medium. The coating had a magenta color.

This coating was found to produce a pleasing clear-on-magenta transparent copy from printed text using a 3M Thermofax TM copier set at ⅔ maximum setting.

EXAMPLE 32

A sheet of the cyan coating prepared in Example 6 was evaluated as a positive imaging system. An electronic signal was used to drive the thermal head of an Oyo Geo Space GS-612 Thermal Plotter to bleach the construction in the background areas. A positive cyan image on a clear background resulted.

This coating was also found to produce a pleasing clear-on-cyan transparent negative image copy from printed text using a 3M Thermofax TM copier set at ⅔ maximum setting.

EXAMPLES 33-34

Examples 33 and 34 demonstrate the improvement when an acid stabilizer is used in the construction in addition to the quaternary-ammonium carbanion-generator as a bleaching agent. As noted above, acid retards pre-bleaching of the dye prior to coating, during coating, and in the drying ovens; and results in longer solution pot life, higher $D_{max}$ of the coated material, and improved shelf life of the thermally bleachable coatings. In a manner similar to that above, antihalation coating solutions were prepared. Example 33 contains an acid stabilizer, Example 34 does not.

| Material | Ex. 33 | Ex. 34 |
|---|---|---|
| Solution A: | | |
| Cellulose Acetate Butyrate (CAB) | 0.5239 g | 0.5239 g |
| Goodyear PE 200 Polyester | 0.0073 g | 0.0073 g |
| 2-Butanone | 3.6794 g | 3.6794 g |
| Toluene | 1.7890 g | 1.7890 g |
| Solution B | | |
| 4-Nitrophenylsulfonylacetic acid | 0.0419 g | 0.0000 g |
| Acetone | 1.6900 g | 0.0000 g |

-continued

| Material | Ex. 33 | Ex. 34 |
|---|---|---|
| Solution C | | |
| Dye D-5 | 0.0273 g | 0.0273 g |
| Acetone | 1.9270 g | 1.9270 g |
| Solution D | | |
| Carbanion Generator C1-A1 | 0.0198 g | 0.0198 g |
| Methanol | 1.5998 g | 1.5998 g |

The solutions were mixed and coated at 3 mil (76 μm) wet thickness on 3 mil (76 μm) polyester and dried at 180° F. (82° C.) for 4 minutes. The coatings had the following absorbances:

| | | |
|---|---|---|
| Absorbance at 780 nm | 1.2000 | 0.5200 |
| Absorbance at 820 nm | 1.3100 | 0.5290 |

The absorbance of Example 33, the coating containing acid stabilizer, has a higher $D_{max}$ than that of Example 34, the coating containing no acid stabilizer. Upon running through a 3M Model 9014 Thermal Processor at 260° F. (127° C.) for 10 seconds, the coatings bleached completely. The coatings had no measurable absorbance at 780 or 820 nm.

EXAMPLES 35-37

Examples 35-37 compare the reactivity of the various antihalation layers using combinations of anions in the quaternary-ammonium salt, "acid salt," or acid. By adjusting the formulation to the same initial absorbance using a combination of different anions for the acid or "acid salt" a increase in reactivity is obtained. This is evidenced by a shortened bleaching times of Examples 35 and 36. As shown in Example 37, when only one anion is used for quaternary-ammonium salt, "acid salt" and acid, longer bleaching times are obtained.

| Material | Ex. 35 | Ex. 36 | Ex. 37 |
|---|---|---|---|
| Solution A | | | |
| Cellulose Acetate Butyrate (CAB) | 0.9973 g | 0.9973 g | 0.9973 g |
| Goodyear PE 200 Polyester | 0.0626 g | 0.0626 g | 0.0626 g |
| 2-Butanone | 6.9402 g | 6.9402 g | 6.9402 g |
| Solution B | | | |
| 4-Nitrophenylsulfonylacetic acid | 0.0236 g | | |
| 4-Chlorophenylsulfonylacetic acid | | 0.0082 g | 0.0082 g |
| Acetone | 0.9547 g | 0.3308 g | 0.3308 g |
| Solution C | | | |
| Dye D5 | 0.0273 g | 0.0273 g | 0.0273 g |
| Acetone | 1.3270 g | 1.3270 g | 1.3270 g |
| Methyl-2-pentanone | 0.6000 g | 0.6000 g | 0.6000 g |
| Solution D | | | |
| Carbanion Generator C1-A1 | 0.0161 g | | |
| Carbanion Generator C1-A7 | | 0.0084 g | 0.0084 g |
| Methanol | 0.6472 g | 0.6747 g | 0.6747 g |
| Dimethylformamide | 0.6472 g | | |
| Solution E | | | |
| Guanidinium 4-nitrophenylsulfonylacetate | 0.0212 g | 0.0222 g | |
| Guanidinium 4-chlorophenylsulfonylacetate | | | 0.0215 g |
| Methanol | 0.8613 g | 0.9023 g | 1.3980 g |
| Dimethylformamide | 0.8613 g | 0.9023 | |

The mole ratios of the various reactants are as follows:

| Material | Ex. 35 | Ex. 36 | Ex. 37 |
|---|---|---|---|
| Dye | 1 | 1 | 1 |
| Carbanion generator | 0.636 | 0.664 | 0.664 |
| Guanidinium salt | 1.5537 | 1.627 | 1.627 |
| Phenylsulfonylacetic acid | 2.1300 | 0.776 | 0.776 |
| Absorbance at 820 nm | 1.100 | 1.100 | 1.100 |
| Bleaching time at 260° F. | 11 seconds | 8 seconds | 20 seconds |

EXAMPLES 38-39 DEMONSTRATE THE USE OF QUATERNARY-PHOSPHONIUM AND QUATERNARY-ARSONIUM PHENYLSULFONYLACETATE BLEACHING AGENTS WITH POLYMETHINE DYES

As noted above, as used herein the term "quaternary-ammonium" includes atoms that are in the same group in the periodic table as nitrogen. Such atoms include phosphorus, arsenic, antimony, and bismuth.

EXAMPLE 38

In a manner similar to that described in Example 8 above, the following solutions were prepared:

| Material | Ex. 38 |
|---|---|
| Solution A: | |
| Cellulose Acetate Butyrate (CAB) | 0.5239 g |
| Goodyear PE-200 Polyester | 0.0073 g |
| 2-Butanone | 3.6790 g |
| Toluene | 1.7890 g |
| 4-Methyl-2-pentanone | 0.6000 g |
| Solution B: | |
| 4-Nitrophenylsulfonylacetic acid | 0.0419 g |
| Methanol | 1.6900 g |
| Solution C: | |
| Dye D5 | 0.0273 g |
| Methanol | 1.9270 g |
| Solution D: | |
| Carbanion Generator C10-A1 | 0.0334 g |
| Methanol | 2.7000 g |

The solution was coated on polyester film at 3 mil (76 μm) wet thickness and dried at 180° F. (82° C.) for 4 minutes. The absorbance at 820 nm was 1.006. Upon running through a 3M Model 9014 Thermal Processor at 260° F. (127° C.) for 10 seconds, complete bleaching was obtained.

EXAMPLE 39

In a manner similar to that described in Example 8 above, the following solutions were prepared:

| Material | Ex. 39 |
|---|---|
| Solution A: | |
| Cellulose Acetate Butyrate (CAB) | 0.5239 g |
| Goodyear PE-200 Polyester | 0.0073 g |
| 2-Butanone | 3.6790 g |
| Toluene | 1.7890 g |
| 4-Methyl-2-pentanone | 0.6000 g |
| Solution B: | |
| 4-Nitrophenylsulfonylacetic acid | 0.0419 g |
| Methanol | 1.6900 g |
| Solution C: | |
| Dye D5 | 0.0273 g |
| Methanol | 1.9270 g |
| Solution D: | |
| Carbanion Generator C11-A1 | 0.0359 g |
| Methanol | 2.9050 g |

The solution was coated on polyester at 3 mil (76 μm) wet thickness and dried at 180° F. (82° C.) for 4 minutes. The absorbance at 820 nm was 0.776. Upon running through a 3M Model 9014 Thermal Processor at 260° F. (127° C.) for 10 seconds, complete bleaching was obtained.

The invention has been described with reference to various specific and preferred embodiments and techniques. It should be understood, however, that many variations and modifications may be made while remaining within the spirit and scope of the invention as claimed.

TABLE II

Bleachable Dyes of General Formula I

| Dye | n | $X^-$ | $NR^1R^2$ | W | $R^5$ | $R^6$ |
|---|---|---|---|---|---|---|
| D1 | 1 | $CF_3SO_3^-$ | $N(CH_3)_2$ | $N(CH_3)_2$ | 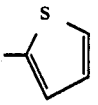 | 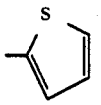 |
| D2 | 1 | $CF_3SO_3^-$ | $N(CH_3)_2$ | $N(C_2H_4OCH_3)_2$ | H | 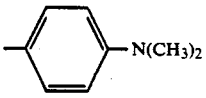 |
| D3 | 1 | $CF_3SO_3^-$ | $N(CH_3)_2$ | 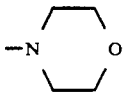 | H | 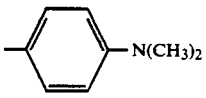 |

TABLE III

Bleachable Dyes of General Formula II

| Dye | n | $X^-$ | $NR^1R^2$ | W | $R^7$ | $R^8$ |
|---|---|---|---|---|---|---|
| D4 | 1 | $CF_3SO_3^-$ | $N(CH_3)_2$ | $N(CH_3)_2$ | $N(CH_3)_2$ | $N(CH_3)_2$ |
| D5 | 1 | $CF_3SO_3^-$ | $N(CH_3)_2$ | $N(CH_3)_2$ | H | H |
| D6 | 1 | $4\text{-}CH_3—C_6H_4—SO_3^-$ | $N(CH_3)_2$ | $N(CH_3)_2$ | $N(CH_3)_2$ | $N(CH_3)_2$ |
| D7 | 1 | $CF_3SO_3^-$ | $N(CH_3)_2$ | $N(CH_3)_2$ | 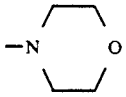 | 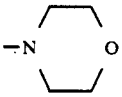 |
| D8 | 1 | $CF_3SO_3^-$ | $N(C_2H_5)_2$ | $N(C_2H_5)_2$ | $N(C_2H_5)_2$ | $N(C_2H_5)_2$ |
| D9 | 1 | $CF_3SO_3^-$ | 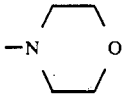 | 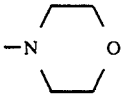 | 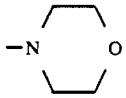 | 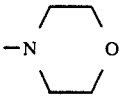 |
| D10 | 1 | $CF_3SO_3^-$ | $N(CH_3)_2$ | $N(CH_3)_2$ | 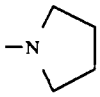 | 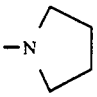 |
| D11 | 1 | $CF_3SO_3^-$ | $N(C_2H_4OCH_3)_2$ | $N(C_2H_4OCH_3)_2$ | 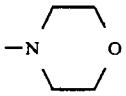 | 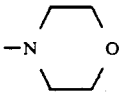 |
| D12 | 1 | $CF_3SO_3^-$ | $N(C_2H_5)_2$ | $N(C_2H_5)_2$ | 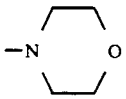 | 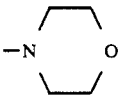 |
| D13 | 1 | $CF_3SO_3^-$ | $N(CH_3)_2$ | $N(CH_3)_2$ | $N(CH_3)_2$ | 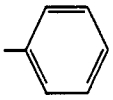 |
| D14 | 1 | $C_2F_5—C_6F_{10}—SO_3^-$ (PECHS$^-$) | $N(CH_3)_2$ | $N(CH_3)_2$ | H | H |
| D15 | 1 | $C_2F_5—C_6F_{10}—SO_3^-$ (PECHS$^-$) | $N(CH_3)_2$ | $OCH_3$ | $OCH_3$ | $N(CH_3)_2$ |

What is claimed is:

1. A thermal-dye-bleach construction comprising a polymethine dye having a nucleus of formula:

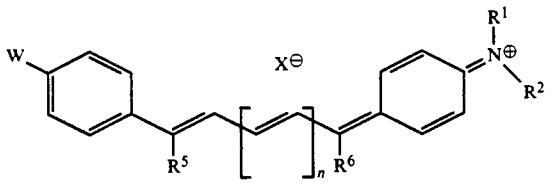

wherein:

n is 0, 1, 2 or 3;

W is selected from: hydrogen, alkyl groups of up to 10 carbon atoms, alkoxy and alkylthio groups of up to 10 carbon atoms, aryloxy and arylthio groups of up to 10 carbon atoms, $NR^1R^2$, and $NR^3R^4$;

$R^1$ to $R^4$ are each independently selected from: alkyl groups of up to 20 carbon atoms, alkenyl groups of up to 20 carbon atoms, and aryl groups of up to 14 carbon atoms; or $R^1$ and $R^2$ together and/or $R^3$ and $R^4$ together may represent the necessary atoms to complete a 5-, 6-, or 7-membered heterocyclic ring group; or one or more of $R^1$ to $R^4$ may represent the atoms necessary to complete a 5- or 6-membered heterocyclic ring group fused to the phenyl ring on which the $NR^1R^2$ or $NR^3R^4$ group is attached;

$R^5$ and $R^6$ are each independently selected from: hydrogen atoms, alkyl groups of up to 20 carbon atoms, aryl groups of up to 20 carbon atoms, heterocyclic ring groups comprising up to 6 ring atoms, carbocyclic ring groups comprising up to 6 carbon atoms and fused ring and bridging groups comprising up to 14 ring atoms;

and, $X^-$ is an anion;

in association with a thermal-carbanion-generating agent of general formula:

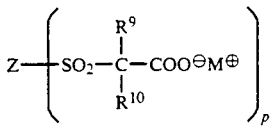

wherein:

$R^9$ and $R^{10}$ are individually selected from: hydrogen, an alkyl group, an alkenyl group, a cycloalkyl group, an aralkyl group, an aryl group, and a heterocyclic group;

$M^+$ is a cation which will not react with the carbanion generated from said thermal carbanion generating agent in such manner as to render said carbanion ineffective as a bleaching agent for said polymethine dye;

p is one or two, and when p is one, Z is a monovalent group selected from: an alkyl group, a cycloalkyl group, an alkenyl group, an alkynyl group, an aralkyl group, an aryl group, and a heterocyclic group, and; when p is two, Z is a divalent group selected from: an alkylene group, arylene group, a cycloalkylene group, an alkynylene group, an aralkylene group, an alkenylene group, and a heterocyclic group.

2. The thermal-dye-bleach construction as claimed in claim 1 wherein:

$R^1$ to $R^4$ are each independently selected from: alkyl groups of up to 10 carbon atoms and alkenyl groups of up to 10 carbon atoms;

or $R^1$ and $R^2$ together and/or $R^3$ and $R^4$ together may represent the necessary non-metallic atoms to complete a heterocyclic ring group comprising up to 6 atoms selected from C, N, O, and S; and $R^5$ and $R^6$ are selected from: alkyl groups of up to 5 carbon atoms, aryl groups of up to 10 carbon atoms, heterocyclic ring groups comprising up to 6 ring atoms, carbocyclic ring groups comprising up to 6 carbon atoms, and fused ring and bridging groups comprising up to 14 ring atoms.

3. The thermal-dye-bleach construction as claimed in claim 1 wherein:

W represents alkoxy groups of up to 5 carbon atoms, $NR^1R^2$, and $NR^3R^4$;

$R^1$ to $R^4$ are each independently selected from the group consisting of methyl, ethyl, and methoxyethyl groups; or $R^1$ and $R^2$ together and/or $R^3$ and $R^4$ together represent the necessary non-metallic ring atoms to complete morpholine, piperidine, or pyrrolidine ring;

$R^5$ and $R^6$ are each independently selected from: hydrogen, phenyl, 4-dimethylaminophenyl, 4-diethylaminophenyl, 4-bis(methoxyethyl)aminophenyl, 4-N-pyrrolidinophenyl, 4-N-piperidinophenyl, 4-N-morpholinophenyl, 4-N-azacycloheptyl, 4-dimethylamino-1-naphthyl, 4-methoxy-phenyl, and 4-ethoxyphenyl groups; or $R^5$ and/or $R^6$ may represent the necessary atoms to complete a thiophene group; and, $X^-$ represents trifluoromethanesulfonate, 4-toluenesulfonate, perfluorooctanesulfonate, perfluoro(ethylcyclohexane)sulfonate, or dodecylbenzenesulfonate.

4. The thermal-dye-bleach construction as claimed in claim 1 wherein the polymethine dye has a nucleus of formula:

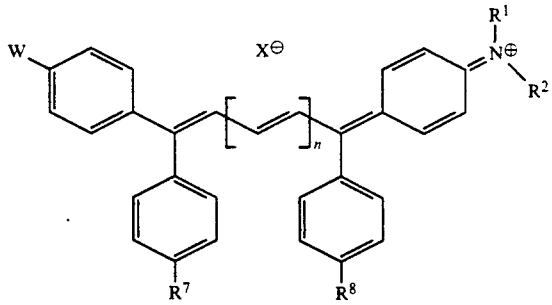

wherein:

$R^7$ and $R^8$ are each independently selected from the group consisting of alkoxy groups of up to 5 carbon atoms, $NR^1R^2$ or $NR^3R^4$ wherein $R^1$ to $R^4$ are each independently alkyl groups of up to 5 carbon atoms, hydrogen atoms, alkenyl groups of up to 5 carbon atoms, and aryl groups of up to 10 carbon atoms.

5. The thermal-dye-bleach construction as claimed in claim 1 wherein said thermal carbanion-generating agent comprises a quaternary-ammonium salt of a phenylsulfonylacetic acid which liberates one or more free carbanion groups upon thermal decomposition.

6. The thermal-dye-bleach construction as claimed in claim 5 wherein the thermal-carbanion-generating quaternary-ammonium salt of said phenylsulfonylacetic acid is represented by the following formula:

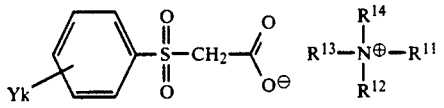

wherein:

Y represents a carbanion-stabilizing group;

k is 0–5; and $R^{11}$ to $R^{14}$ are individually a $C_1$ to $C_{18}$ alkyl, alkenyl, aralkyl, or aryl group with the proviso that the total sum of carbon atoms contained in $R^{11}+R^{12}+R^{13}+R^{14}$ will not exceed 22.

7. The thermal-dye-bleach construction as claimed in claim 6 in which said thermal-carbanion generating agent comprises a cation selected from C1 to C13 in combination with an anion selected from A1 to A7

| Cations | |
|---|---|
| Tetramethylammonium$^+$ | C1 |
| Tetraethylammonium$^+$ | C2 |
| Tetrapropylammonium$^+$ | C3 |
| Tetrabutylammonium$^+$ | C4 |
| Benzyltrimethylammonium$^+$ | C5 |
| Li-12-Crown-4$^+$ | C6 |
| Na-15-Crown-5$^+$ | C7 |
| K-Dibenzo-18-Crown-6$^+$ | C8 |
| K-18-Crown-6$^+$ | C9 |
| Tetraphenyl phosphonium$^+$ | C10 |
| Tetraphenyl arsonium$^+$ | C11 |
| N-Dodecyl pyridinium$^+$ | C12 |
| Dodecyltrimethylammonium$^+$ | C13 |

Anions

A1

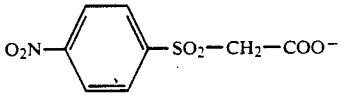

A2

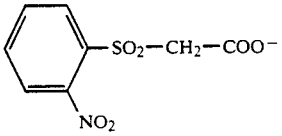

A3

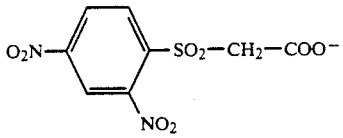

A4

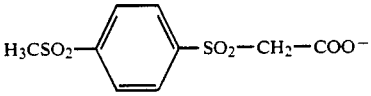

A5

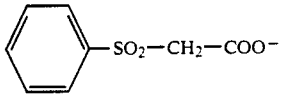

A6

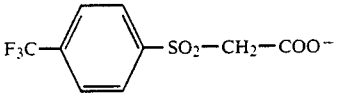

-continued

A7.

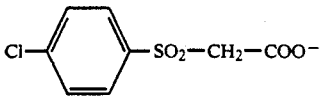

8. The thermal-dye-bleach construction as claimed in claim 1 which further comprises a carboxylic acid or a phenylsulfonylacetic acid.

9. The thermal-dye-bleach construction as claimed in claim 8 comprising phenylsulfonylacetic acid or a phenylsulfonylacetic acid wherein the phenyl ring is substituted.

10. The thermal-dye-bleach construction as claimed in claim 9 in which said phenylsulfonylacetic acid or said phenylsulfonylacetic acid wherein the phenyl ring is substituted is derived from acidification of the anions selected from A1 to A7

Anions

A1

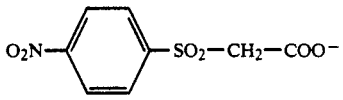

A2

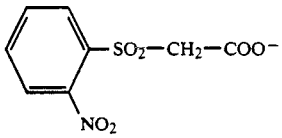

A3

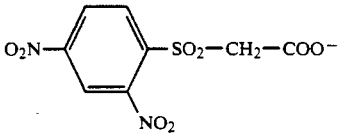

A4

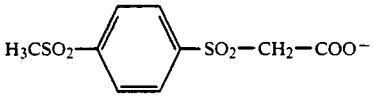

A5

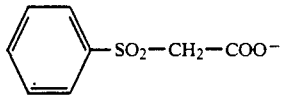

A6

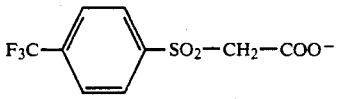

A7.

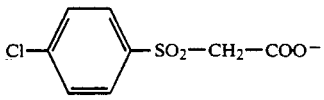

11. The thermal-dye-bleach construction as claimed in claim 10 in which said phenylsulfonylacetic acid or said phenylsulfonylacetic acid wherein the phenyl ring is substituted is in the form of an acid-salt.

12. The thermal-dye-bleach construction as claimed in claim 8 which further comprises a thermal-amine-generating agent.

13. The thermal-dye-bleach construction as claimed in claim 12 in which said thermal-amine-generating agent is an ammonium salt of a phenylsulfonylacetic acid for which the amine contains at least one labile hydrogen atom.

14. The thermal-dye-bleach construction as claimed in claim 12 in which said thermal-amine-generating agent is a guanidinium salt of a phenylsulfonylacetic acid for which said guanidinium salt contains at least one labile hydrogen atom.

15. The thermal-dye-bleach construction as claimed in claim 1 in the form of a photographic element comprising a support bearing an electromagnetic radiation-sensitive-photographic silver halide, the element comprising as an antihalation or acutance agent, said thermal carbanion-generating agent, and said polymethine dye.

16. The thermal-dye-bleach construction as claimed in claim 15 in which said photographic silver halide is infrared-sensitive.

17. The thermal-dye-bleach construction as claimed claim 15 in which said radiation-sensitive photographic silver halide is a photothermographic medium.

18. The thermal-dye-bleach construction as claimed in claim 15 in which said antihalation agent contains said polymethine dye in an amount to provide a transmission optical density of at least 0.1 at the λmax of the dye.

19. The thermal-dye-bleach construction as claimed in claim 15 in which said polymethine dye is present in an amount in the range from 0.1 to 1.0 mg/dm$^2$.

* * * * *